US010900658B1

(12) United States Patent
Lee

(10) Patent No.: US 10,900,658 B1
(45) Date of Patent: Jan. 26, 2021

(54) LIGHT FIXTURE FOR REPAIR TOOLS

(71) Applicant: Taizhou Beswell Machinery Co., Ltd., Taizhou (CN)

(72) Inventor: Nile Lee, Taizhou (CN)

(73) Assignee: Taizhou Beswell Machinery Co., Ltd., Taizhou (CN)

( * ) Notice: Subject to any disclaimer, the term of this patent is extended or adjusted under 35 U.S.C. 154(b) by 0 days.

(21) Appl. No.: 16/739,984

(22) Filed: Jan. 10, 2020

(30) Foreign Application Priority Data

Dec. 6, 2019 (CN) ..... 2019 2 2170498 U

(51) Int. Cl.

| | |
|---|---|
| ***F21V 33/00*** | (2006.01) |
| ***F21S 9/02*** | (2006.01) |
| ***F21V 5/00*** | (2018.01) |
| ***F21V 23/04*** | (2006.01) |
| ***F21Y 115/10*** | (2016.01) |

(52) U.S. Cl.
CPC ..... *F21V 33/0084* (2013.01); *F21S 9/02* (2013.01); *F21V 5/007* (2013.01); *F21V 23/0442* (2013.01); *F21Y 2115/10* (2016.08)

(58) Field of Classification Search
CPC .. F21V 33/0084; F21V 5/007; F21V 23/0442; F21V 31/03; F21S 9/02; F21Y 2115/10; F21L 4/027; F21L 4/08; F21L 4/085; F21L 4/02; F21W 2131/402
See application file for complete search history.

(56) References Cited

U.S. PATENT DOCUMENTS

| | | | | |
|---|---|---|---|---|
| 3,329,810 | A * | 7/1967 | Meagher | F21L 15/00 362/158 |
| 8,317,357 | B2 * | 11/2012 | Bayat | F21V 23/0414 362/206 |
| 9,470,382 | B1 * | 10/2016 | Sharrah | F21V 3/00 |
| 9,746,170 | B1 * | 8/2017 | Armer | B63C 11/02 |
| 10,361,409 | B2 * | 7/2019 | Liu | H01M 2/10 |
| 10,584,855 | B1 * | 3/2020 | Drost | F21V 31/03 |
| 2011/0292643 | A1 * | 12/2011 | Chen | F21V 21/108 362/183 |
| 2014/0118998 | A1 * | 5/2014 | Mabry | A62C 31/02 362/184 |
| 2015/0251299 | A1 * | 9/2015 | Fu | B25B 21/00 362/119 |
| 2016/0281965 | A1 * | 9/2016 | Schneider | B64F 1/002 |
| 2017/0368677 | A1 * | 12/2017 | Rotenberg | F21V 21/096 |
| 2017/0370535 | A1 * | 12/2017 | Wu | B25B 15/00 |
| 2020/0116314 | A1 * | 4/2020 | Grandadam | F21V 14/045 |

* cited by examiner

*Primary Examiner* — Peggy A Neils
(74) *Attorney, Agent, or Firm* — Grumbles Law, PLLC; Brittany R. Nanzig

(57) ABSTRACT

A light fixture for repair tools that includes a housing, a battery compartment in the lower part of the housing, a hole in the center of the housing, two light source openings on both sides of this hole, a mount for a mounting plate on the inside of the housing, and an LED mounting plate built into this mount. Two LEDs are located on this plate, compatible with the above light source openings, and at the bottom of the LED mounting plate there is a sensor switch. Lightweight reinforced plastic is used for the light fixture, the edge of the housing is made using bicomponent casting technology, and the notches on both sides have an anti-slip design. The housing allows achievement of a good light focusing effect, the fixtures are resistant to vibration and loosening, the battery can be repeatedly recharged, and the device is convenient to use and repair.

11 Claims, 7 Drawing Sheets

LIGHT FIXTURE FOR REPAIR TOOLS

FIELD OF THE INVENTION

This disclosure relates to the technical field of lighting devices, in particular, to the field of light fixtures for repair tools.

BACKGROUND OF THE INVENTION

Currently, repair tools (manual, electric, pneumatic, hydraulic) are widely used in various fields, and lighting devices are a necessary element when working with a repair tool. Lighting devices are used to improve working conditions, contribute to better monitoring and control of the work process, facilitate work of technical personnel and ensure the safety and stability of repair work.

Existing manual, pneumatic and hydraulic tools do not have lighting devices, so when performing work in fairly cloudy weather or at night, one has to resort to the use of additional lighting devices. In some power tools, even those with lighting devices, the focusing of light is poor, in certain circumstances, for example, in a narrow space. Further, the installed lighting devices are not easy to disassemble, and they can easily break if exposed to vibration. If such a device breaks, it will be necessary to repair and inspect the entire circuit. No effective solution to this issue has been found at present.

SUMMARY OF THE INVENTION

As a result of the aforementioned technical issues, this disclosure relates to lighting devices, in particular, to light fixtures for repair tools, wherein the fixture is resistant to vibration and loosening, the focusing of light in the device is good, and it is convenient to install and repair. In an illustrative but non-limiting example, the light fixture for repair tools can include a round housing, a battery compartment located in the lower part of the housing, an opening located in the centre of the housing, two openings for the light source that may be provided on both sides of the opening, and a mounting plate mount located on the inside of the housing, wherein an LED mounting plate can be built into this mounting plate mount. Two LEDs can be located on the LED mounting plate, may be compatible with the two light source openings, and at the bottom of the LED mounting plate there may be a sensor switch.

A rechargeable battery can be installed in the battery compartment, and this battery can be connected to the LED mounting plate.

The mounting plate mount can include a front and a rear cover plate. The front cover plate may be equipped with two lens openings that are compatible with LEDs. Lenses can be installed in the lens openings, and the bases of the lenses can be rectangular. Where the rear cover plate is adjacent to the LED mounting plate, there may be a USB charging connector. Further, in the rear cover there can be an opening for access to the USB charging connector.

The aforementioned mounting plate mount can be installed in the housing using self-tapping screws.

This embodiment may further include a plurality of gutters 1D in the form of rectangular stripes on both sides of the outer surface of the housing 1, three first level limiters 1-2 inside the housing 1, and three first level grooves 1-1 for the secure connection of tool barrel limiters 8-2 inside the round opening of the housing 1.

In some cases, the touch sensor switch can pass through the front cover plate of the mounting plate mount 9 and the housing 1.

In this, and other, embodiment, a tool barrel cover 8 is installed into the housing 1, three first level limiters 1-2 of the housing may be screwed into three second level grooves 8-1 of the tool barrel cover 8, and three second level limiters 8-2 of the tool barrel cover may be screwed into the three first level grooves 1-1 of the housing 1.

In some cases, lightweight reinforced plastic can be used as the material for the housing. And in some embodiments, optical lenses are used as the lenses.

The benefits of this device are that lightweight reinforced plastic is used as the material for the light fixture, the edge of the housing is made using bicomponent casting technology, the notches on both sides have an anti-slip design, the housing has a pleasant appearance and is pleasant to the touch, the device allows achievement of a good light focusing effect, the fixtures are resistant to vibration and loosening, the battery can be recharged many times, and the device is convenient to use and repair.

The above summary is not intended to describe each and every example or every implementation of the disclosure. The description that follows more particularly exemplifies various illustrative embodiments.

BRIEF DESCRIPTION OF THE DRAWINGS

To explain examples of the implementation of this design and technical solutions for existing technologies more clearly, the following is a brief description of the drawings necessary for the implementation options of the light fixture for repair tools. Obviously, the drawings below are just a few options for implementing this design. Normal technical personnel in this field can make other drawings based on those presented without the need to create their own inventions.

DETAILED DESCRIPTION

The drawings show an example of implementation of this design. This example provides a clear, integral description of the technical solution for implementing this design. Obviously, the described implementation example is only a partial implementation of the design, and not its full implementation. According to this example of implementation of the design, all other implementation examples obtained by normal technical personnel in this field depend on the protection area of this design.

Figure 1:
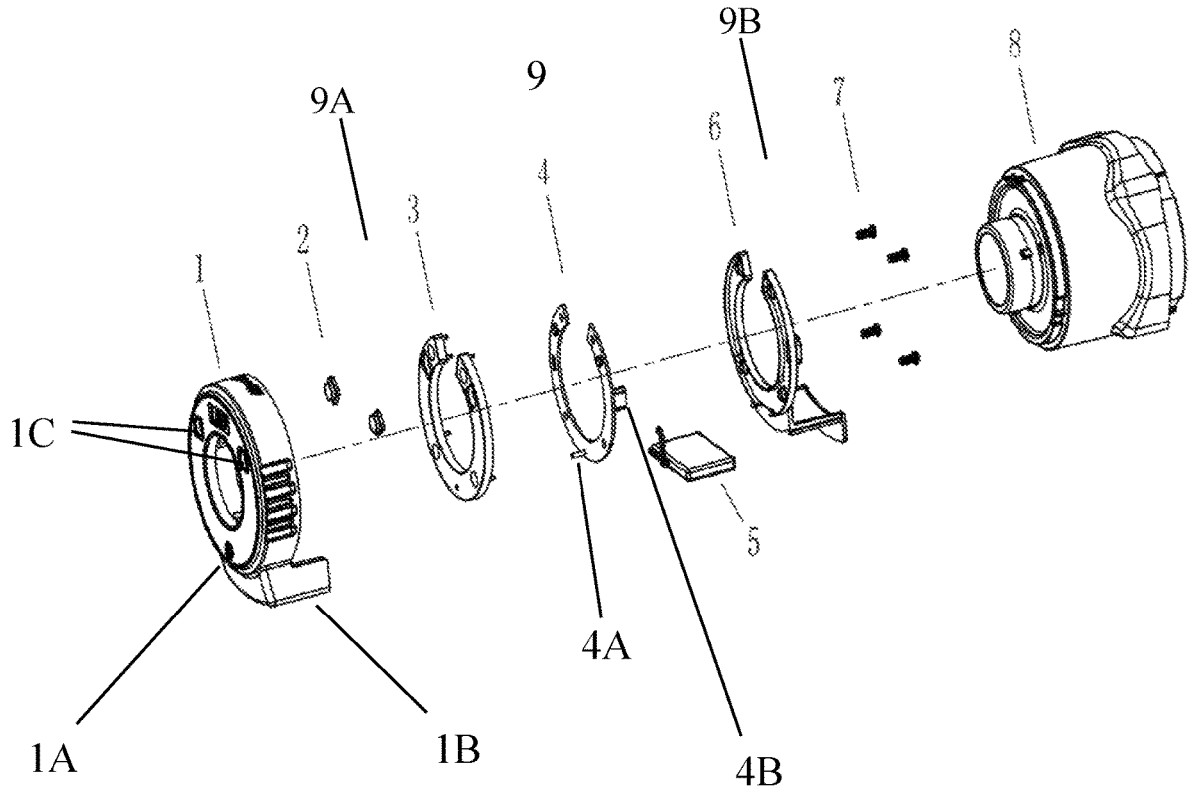
FIG. 1 is a detail drawing of light fixture for repairs according to the present design.

As shown in FIG. 1, the light fixture for repair tools includes a round housing 1, in the bottom of the housing 1 there is a battery compartment 1*i*, and in the center of the housing 1 there is an opening. There are two light source openings 1C on the front face of the housing 1 that are on opposite sides of the opening in the housing 1. On the inside of the housing 1 there is a mount for the mounting plate mount, and an LED mounting plate 4 is installed into the mounting plate mount. On the LED mounting plate 4 there are two LEDs that are compatible with the aforementioned light source openings 1C. At the bottom of the LED mounting plate 4 there is a sensor switch 4A.

In this particular implementation of the device, a rechargeable battery can be installed in the battery compartment, and the battery can be connected to the LED mounting plate 4.

Figure 2:
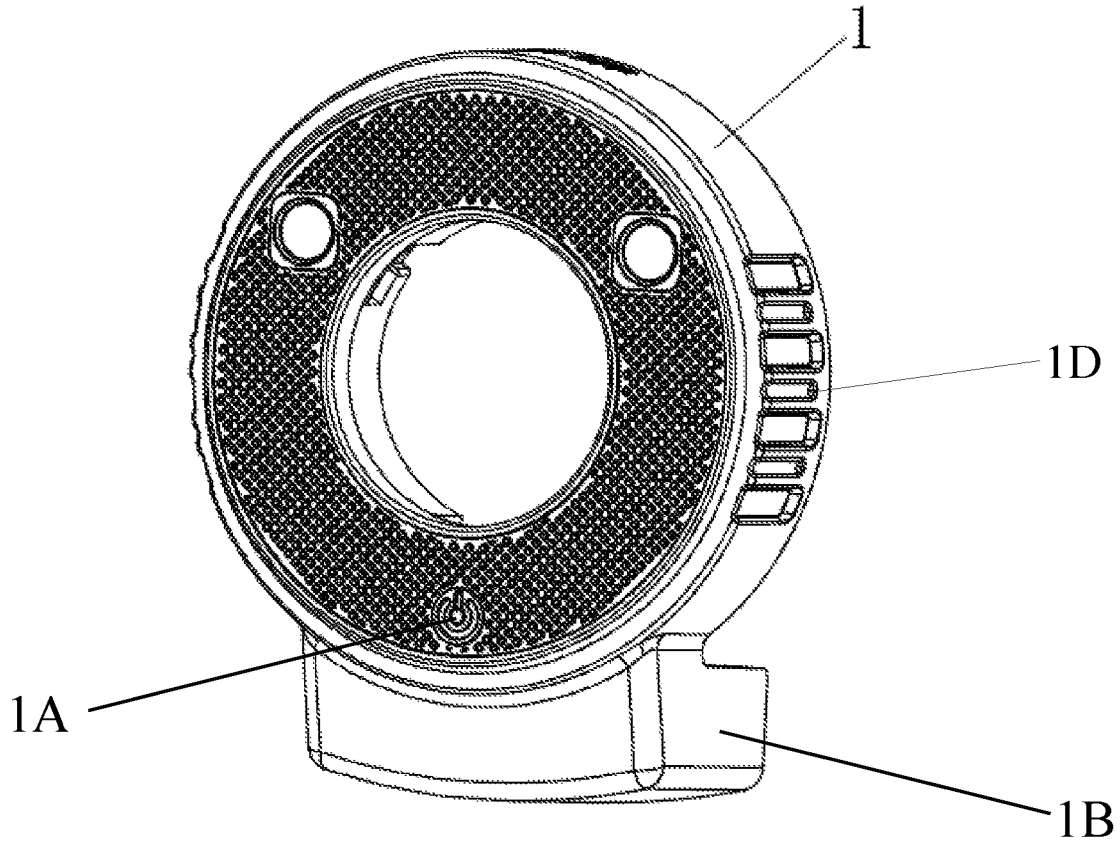
FIG. 2 is a front view of a housing of the light fixture for repairs according to the present design.

In some embodiments, the mounting plate mount 9 (represented between 9A and 9B) can include a front cover 3 and a rear cover 6. The front cover 3 may have two lens openings compatible with the LEDs, as illustrated in FIG. 2. In some cases, lenses 2 may be installed in the lens openings, and the base of the lenses 2 may be rectangular. Where the rear cover 6 of the LED mounting plate 4 is adjacent to the board, there can be a USB charging connector, and there can be an opening in the rear cover 6 for accessing the USB charging connector.

In this particular implementation example of the device, the aforementioned mounting plate mount 9 (represented between 9A and 9B) can be installed in the housing 1 using self-tapping screws 7.

Figure 3:
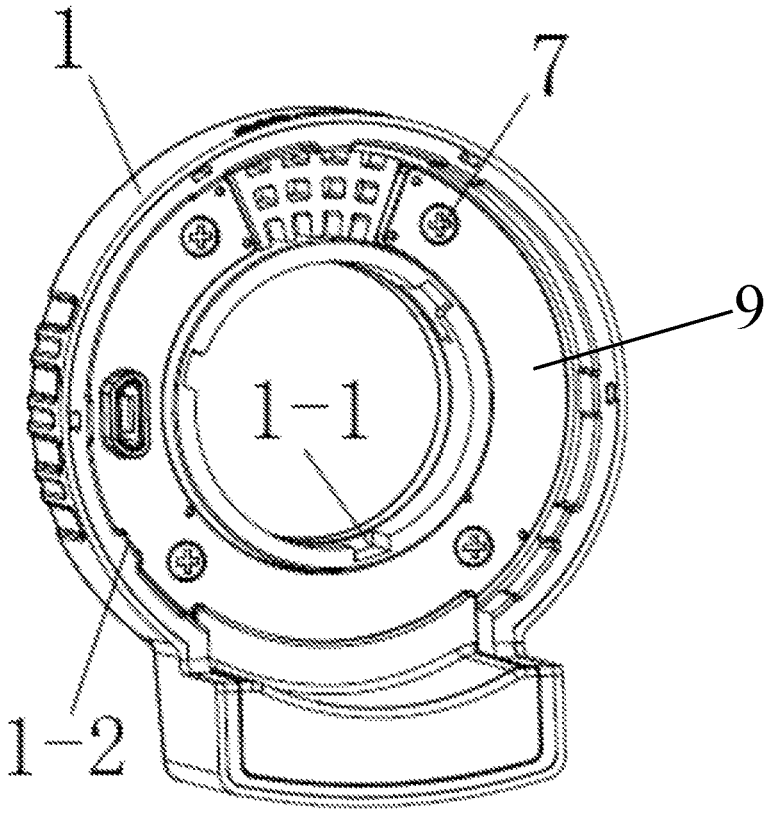
FIG. 3 is a rear view of a housing of the light fixture for repairs according to the present design.
Figure 4:
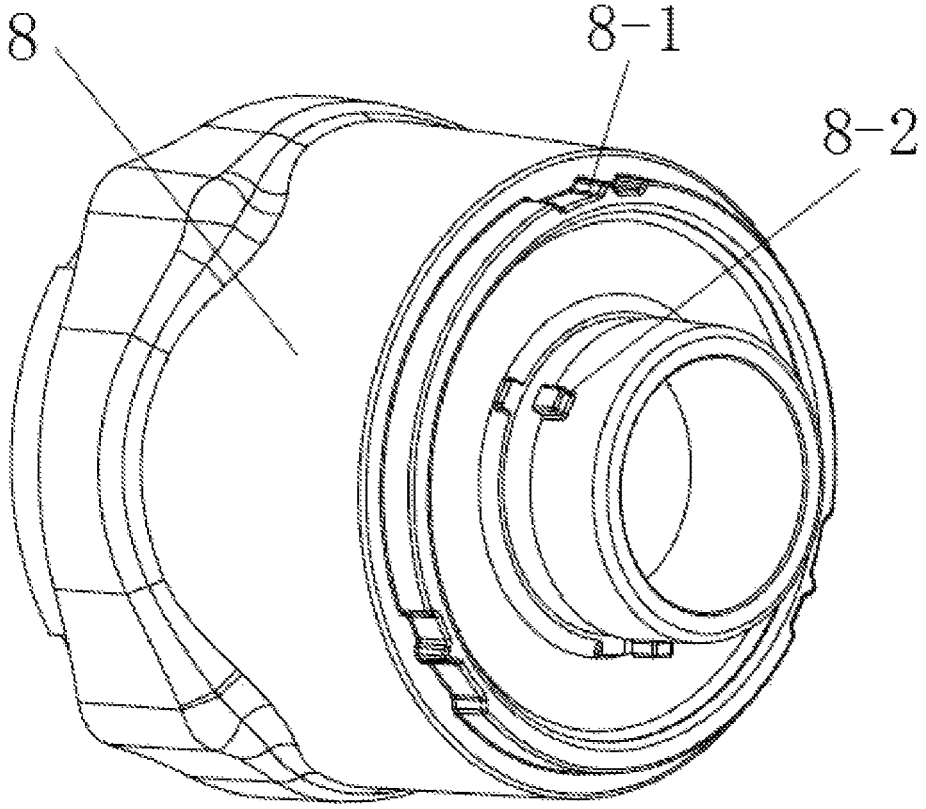
FIG. 4 is a structural diagram of the tool barrel according to the present design.

In some embodiments, the light fixture for repair tools includes several gutters 1D in the form of rectangular stripes on both sides of the outer surface of the housing 1, three first level limiters 1-2 inside the housing 1, and three first level grooves 1-1 inside the opening of the housing 1, as illustrated in FIG. 3.

In this implementation of the device, the aforementioned sensor switch 4A can pass through the front cover plate 3 of the mounting plate mount 9 and the housing 1.

In some embodiments, a tool barrel cover can be installed at the end of the housing 1. The three first level limiters 1-2 of the housing may be screwed into the three second level grooves 8-1, illustrated in FIGS. 5 and 6, for the limiters of the barrel cover 8, and the three second level limiters 8-2 of the barrel cover 8, illustrated in FIGS. 5 and 6, may be screwed into the three first level grooves 1-1 of the housing 1.

In this implementation of the device, housing 1 can be made of lightweight reinforced plastic. Further, optical lenses may be used as lenses 2.

In order to make it easier to understand the above technical solution of this device, a detailed description of the technical solution is given below for specific application methods.

During real use of the light fixture for repair tools in the form of the above-described device, housing 1 is made of lightweight reinforced plastic. The edge of the housing 1 is made using bicomponent casting technology. The notches (i.e., gutters 1D) on both sides are anti-slip. The housing has a pleasant appearance, and it is pleasant to the touch. At the bottom end of housing 1 there is a round sensor switch. The remaining parts on the front side of the housing 1 can be decorated with embossed squares. On the corners of the sides of the housing there can be an embossed ornament of triangles.

There are two lenses 2 inside the housing. Optical lenses are used as lenses to focus the light.

The mounting plate mount is installed inside the housing 1. The mounting plate mount includes the front cover plate 3, the rear cover plate 6, the LED mounting plate 4, and the battery 5; it performs the function of reducing vibration.

LED mounting plate 4 is installed within the mounting plate mount 9. There is one USB connector for recharging on the LED mounting plate 4. During charging, the LED located on the LED mounting plate 4 can flash until the device is fully charged. Located on the mounting plate 4 is the sensor switch 4A, which can be small and easy to operate.

The battery 5 is installed at the bottom of the housing 1 in the battery compartment 1B. The battery 5 can be recharged multiple times.

The housing 1, lenses 2, front cover plate 3, LED mounting plate 4, battery 5, and rear cover plate 6 are fixed together using four screws 7, which makes it easy to install and maintain the device.

Figure 5:
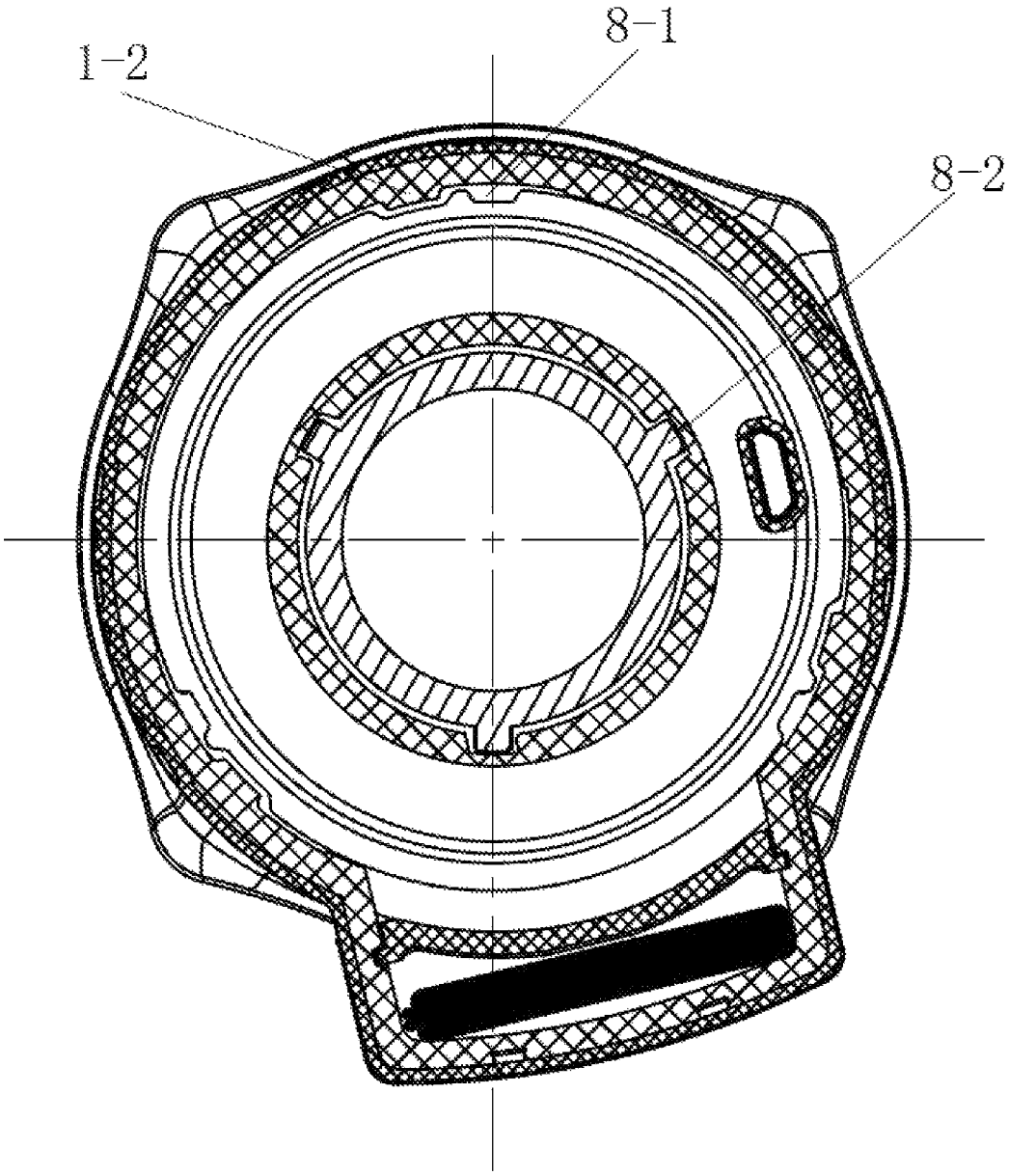
FIG. 5 is a structural diagram of the connection of the fixture housing to the tool barrel according to the present design, at the moment of connection.
Figure 6:
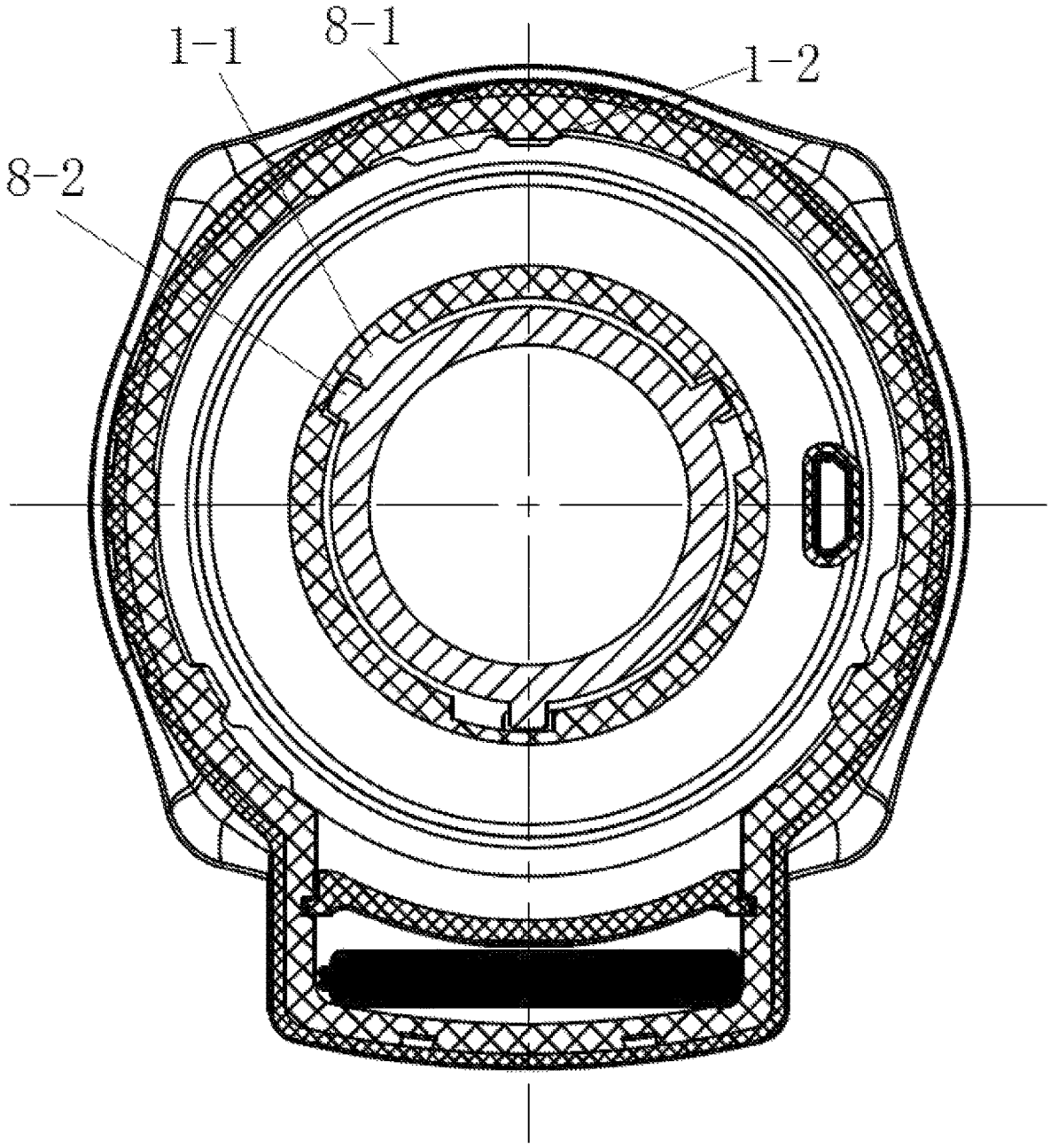
FIG. 6 is a structural diagram of the connection of the fixture housing to the tool barrel according to the present design, after connection.
Figure 7:
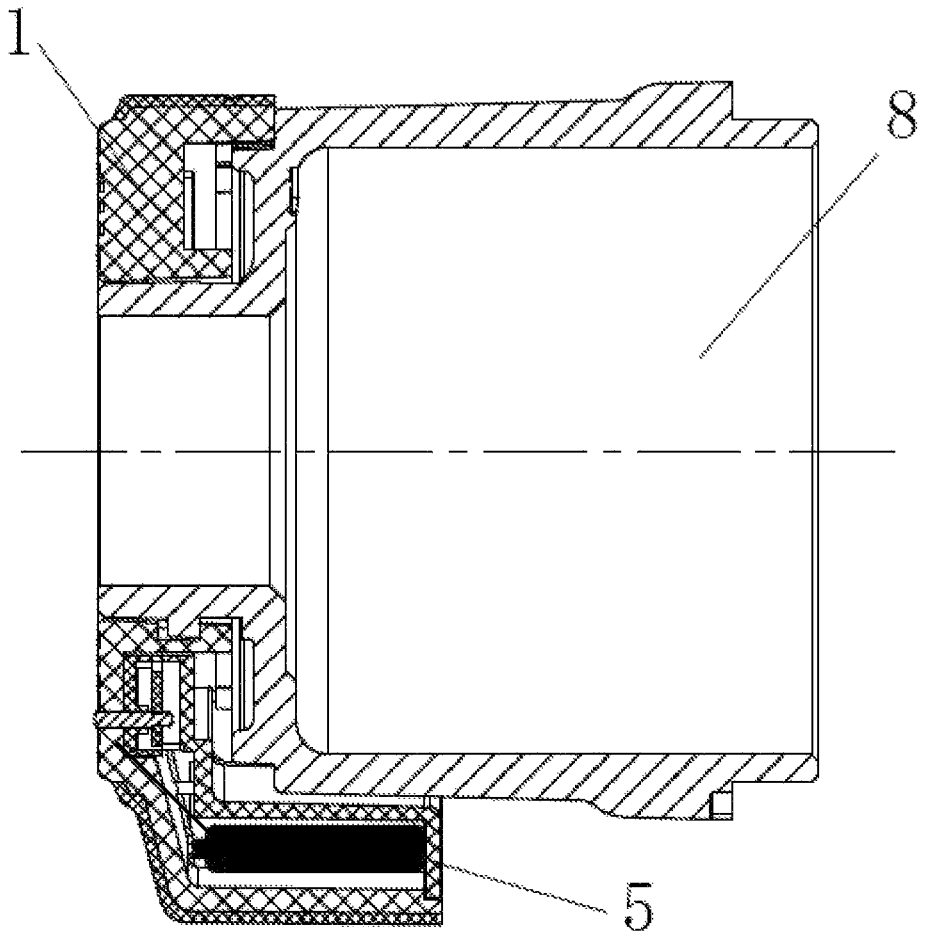
FIG. 7 is a front view of the fixture housing unit and the tool barrel according to the present design.

The tool barrel cover 8 is securely connected to the housing 1, as illustrated in FIG. 7. The connections between these parts are first fixed in the axial direction, primarily by the guide grooves and limiter stops, as illustrated in FIG. 5. After the tool barrel cover 8 is inserted into the housing 1, the housing 1 should be rotated clockwise so that the three limiters 1-2 of housing 1 are aligned with the three grooves 8-1 of the tool barrel cover 8, thus combining the radii and, at the same time, the three limiters 8-2 of the tool barrel cover 8 are screwed into the three grooves 1-1 of housing 1 in the axial direction, as illustrated in FIGS. 5 and 6.

When the housing 1 and the cover of the tool barrel 8 are connected, then, in order to disassemble the device, the housing 1 can be rotated counterclockwise.

Summarizing the above, thanks to the above technical solution of this device, it is possible to increase the focusing of light, reduce vibration, and in addition, the battery can also be recharged many times. This device is convenient to install and repair.

The above is just a relatively good example of the implementation of the device and there is no intent to limit the device to the above description. The idea and principles embodied in this disclosure and all possible corrections, changes, improvements, etc. should be considered in the framework of the protection area of this device.

REFERENCE NUMERALS IN THE DRAWINGS

1. Fixture housing
1A. Sensor switch opening
1B. Battery compartment
1C. Light source openings
1D. Gutters
1-1. First level groove
1-2. First level limiter
2. Lenses
3. Front cover of the mounting plate
4. LED mounting plate
4A. Sensor switch
4B. USB connector
5. Battery
6. Rear cover of the mounting plate
7. Self-tapping screw
8. Cover of the tool barrel
8-1. Second level groove
8-2. Second level limiter
9. Mounting plate mount
9A. Front limit of mounting plate mount
9B. Rear limit of mounting plate mount Persons of ordinary skill in arts relevant to this disclosure and subject matter hereof will recognize that embodiments may comprise fewer features than illustrated in any individual embodiment described by example or otherwise contemplated herein. Embodiments described herein are not meant to be an exhaustive presentation of ways in which various features may be combined and/or arranged. Accordingly, the embodiments are not mutually exclusive combinations of features; rather, embodiments can comprise a combination of different individual features selected from different individual embodiments, as understood by persons of ordinary skill in the relevant arts. Moreover, elements described with respect to one embodiment can be implemented in other embodiments even when not described in such embodiments unless otherwise noted. Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended. Furthermore, it is intended also to include features of a claim in any other independent claim even if this claim is not directly made dependent to the independent claim.

What is claimed is:

1. A light fixture for repair tools, comprising:

a housing having a bottom, a center, an inside surface, and an outer surface;

a battery compartment in the bottom of the housing;

an open end hole in the center of the housing;

a plurality of light source openings on at least two sides of the open end;

a mounting plate mount on the inside of the housing, wherein the mounting plate mount comprises at least one LED mounting plate;

a plurality of LEDs on the LED mounting plate;

at least one first level limiter and at least one second level groove in the housing, such that the housing is structured and configured to be resistant to vibration and loosening; and a sensor switch on the LED mounting plate.

2. The light fixture for repair tools of claim 1, wherein the battery compartment houses a rechargeable battery, and the rechargeable battery is connected to the LED mounting plate.

3. The light fixture for repair tools of claim 1, wherein the mounting plate mount comprises, a front cover plate, a rear cover plate, and a plurality of lenses; the front cover plate having a plurality of lens openings that are compatible with the plurality of LEDs, the plurality of lenses are installed within the plurality of lens openings, bases of the lenses are rectangular, a USB charging connector is located where the rear cover plate is adjacent to the LED mounting plate, and the rear cover plate includes an opening for access to the USB charging connector.

4. The light fixture for repair tools of claim 1, wherein the plurality of screws are self-tapping screws.

5. The light fixture for repair tools of claim 1, further comprising a plurality of gutters on the side of the outer surface of the housing.

6. The light fixture for repair tools of claim 3, wherein the sensor switch passes through the front cover plate and the housing.

7. The light fixture for repair tools of claim 1, wherein a tool barrel cover is installed at an end of the housing, and the tool barrel cover contains three first level limiters, and three second level grooves.

8. The light fixture for repair tools of claim 1, wherein lightweight reinforced plastic is used as the material for the housing.

9. A method for connecting a light fixture for repair tools to a tool barrel cover, the method comprising:

inserting a tool barrel cover with three first level limiters into three first level grooves in a housing of a light fixture for repair tools, and inserting three second level limiters in a housing of a light fixture for repair tools into three second level grooves of a tool barrel cover; and axially rotating the tool barrel cover and the housing, thereby locking the corresponding sets of limiters and grooves together, thereby structuring and configuring the tool barrel cover and housing to be resistant to vibrations and loosening.

10. The light fixture for repair tools of claim 1, wherein the at least one first level limiter and at least one second level groove in the housing permits the plurality of LEDs to be focused during operation.

11. The method for connecting a light fixture for repair tools to a tool barrel cover of claim 9, further comprising the permitting of the plurality of LEDs to be focused during operation.

* * * * *